US006067909A

United States Patent [19]

Knoster, Jr.

[11] Patent Number: 6,067,909

[45] Date of Patent: May 30, 2000

[54] SABOT PRESSURE WAD

[75] Inventor: Richard G. Knoster, Jr., Bedford County, Pa.

[73] Assignee: Sabot Technologies, Inc., Alum Bank, Pa.

[21] Appl. No.: 09/054,785

[22] Filed: Apr. 3, 1998

[51] Int. Cl.[7] ..... F42B 14/06

[52] U.S. Cl. ..... 102/517; 102/439; 102/449; 102/522; 102/532

[58] Field of Search ..... 102/430, 439, 102/448–453, 461, 479, 501, 514–518, 520–523, 532

[56] References Cited

U.S. PATENT DOCUMENTS

| | | | |
|---|---|---|---|
| 3,444,777 | 5/1969 | Lage | 102/453 |
| 3,623,431 | 11/1971 | Hendricks | 102/452 |
| 3,724,378 | 4/1973 | Knight et al. | 102/456 |
| 3,820,463 | 6/1974 | Leonard et al. | 102/439 |
| 4,043,267 | 8/1977 | Hayashi | 102/523 |
| 4,471,699 | 9/1984 | Turco et al. | 102/449 |
| 4,587,905 | 5/1986 | Maki | 102/439 |
| 4,829,904 | 5/1989 | Sullivan | 102/439 |
| 4,864,934 | 9/1989 | Theising | 102/439 |
| 4,895,076 | 1/1990 | Looger et al. | 102/439 |
| 5,086,703 | 2/1992 | Klein | 102/439 |
| 5,415,102 | 5/1995 | White et al. | 102/532 |
| 5,479,861 | 1/1996 | Kinchin | 102/439 |
| 5,515,787 | 5/1996 | Middleton | 102/503 |

FOREIGN PATENT DOCUMENTS

| | | | |
|---|---|---|---|
| 2444181 | 4/1976 | Germany | 102/439 |
| 662878 | 10/1987 | Switzerland | 102/450 |

*Primary Examiner*—Harold J. Tudor
*Attorney, Agent, or Firm*—Webb Ziesenheim Logsdon Orkin & Hanson, P.C.

[57] ABSTRACT

A sabot pressure wad has a unitary sabot portion and an integrally formed pressure wad portion. The sabot portion has a payload receiving compartment which may receive a payload, such as a cylindrical slug, with an interference fit. The pressure wad portion has a gas seal and a shock absorbing device, such as a plurality of chevrons. A separating disc may be positioned between the gas seal and the sabot portion. The gas seal, the separating disc, and the sabot portion all have substantially the same outer diameter. The sabot pressure wad may be a single piece injection-molded part, and may be received within a shell casing along with the payload. The sabot pressure wad remains attached to the payload upon discharge from a firearm until impact with a target.

10 Claims, 2 Drawing Sheets

SABOT PRESSURE WAD

BACKGROUND OF THE INVENTION

1. Field of the Invention

This invention relates to a sabot for a projectile and, more particularly, to a one-piece sabot.

2. Description of Prior Art

A sabot for positioning a projectile, such as a slug, within a shotgun or other gun barrel is well-known. It is also known to form the sabot so that the sabot rotates as the projectile travels the length of a rifled gun barrel. Such a feature is disclosed by U.S. Pat. No. 5,479,801 to Kinchin. The sabot taught by the Kinchin patent imparts rotation to a projectile, which assists in guiding the projectile to a target when the projectile exits the gun barrel. Sabots are also used in smoothbore gun barrels for increasing the stability of the projectile during firing.

In general, sabots are formed in two-piece molded sections which are adapted to surround the exterior of a projectile. After the projectile exits the gun barrel, the sabot splits into two pieces and is discarded. The projectile usually further incorporates a pressure wad which is separate from or mechanically joined to the projectile.

The prior art described above has several disadvantages. First, manufacturing costs are increased because the sabot is formed in two separate pieces requiring two separate molds to make the sabot. Additionally, the two sabot pieces may require welding during the shotgun shell loading process to encase the projectile. This increases labor, production time and costs. Further, the pressure wad is formed as a separate element (requiring still another mold) which, in order to increase the bullet coefficient rating of the projectile, must be joined to the projectile, either before or during firing.

Consequently, it would be advantageous to incorporate the guidance function and higher bullet coefficient rating provided by the pressure wad with a sabot in one unit that is adapted to travel with the projectile to the target. This would enhance coefficient performance while eliminating the need for multiple molds to form the pressure wad and sabot, and would result in streamlining the shell loading process. Further, it would be advantageous to fashion a combined sabot and pressure wad adapted to receive a projectile (or other payload) directly within the sabot, which unit travels with the projectile or payload until impact with the target.

It is therefore an object of the invention to provide a one-piece sabot capable of receiving a projectile or payload and traveling with the projectile or payload to a target.

It is a further object of the invention to provide a sabot which may impart rotation (and thus aerodynamic guidance) to a projectile as the projectile travels toward a target, while also increasing the bullet coefficient rating.

SUMMARY OF THE INVENTION

A sabot pressure wad in accordance with the present invention includes a unitary sabot portion and pressure wad portion, and a payload receiving compartment defined in a front end of the sabot portion. The sabot portion and pressure wad portion are integrally formed as a unitary piece, for example, using injection molded plastic.

The pressure wad portion includes a shock absorbing device and a gas seal. The shock absorbing device may include a plurality of chevrons, integrally formed with and extending between the gas seal and the sabot portion. The gas seal and the sabot portion may have substantially the same diameter.

The sabot portion includes a waist having a leading wall and a deflecting wall. A separating disc is provided between the gas seal and the sabot portion. The payload may be adapted for an interference fit within the payload receiving compartment. The payload may include an integrally formed cover adapted to cover the opening to the payload receiving compartment. The payload can take one of many forms, including, but not limited to, a cylindrical slug, wax, a rubber bullet, a mixture of explosive powder and primer, or a penetrator round.

The payload receiving compartment may include a plurality of splines on an interior surface adapted to create an interference fit between the payload and the interior surface of the payload receiving compartment. The splines are oriented substantially parallel to the longitudinal axis of the sabot portion. The sabot pressure wad may be received within a shell casing, which further includes a powder charge.

During firing, when the powder charge is struck, the gas seal preferably acts to trap gas escaping from the compression of the powder charge and the separating disc traps any escaping gas that the gas seal is unable to contain. The chevrons are preferably axially compressed as a result of the shock of the explosion accompanying the compression of the powder charge.

After exiting the gun barrel, the sabot pressure wad and the payload remain connected during the flight to the target. Upon impacting the target, the payload preferably separates from the sabot portion and penetrates the target.

A complete understanding of the invention will be obtained from the following description when taken in connection with the accompanying drawings.

DETAILED DESCRIPTION OF THE PREFERRED EMBODIMENTS

Figure 1:
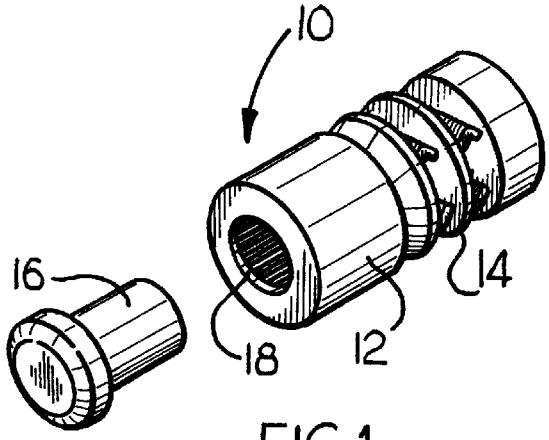
FIG. 1 is an exploded perspective view of a sabot pressure wad and a payload in accordance with the present invention.

FIG. 1 shows a sabot pressure wad 10 made in accordance with the present invention that generally includes a unitary sabot portion 12 and pressure wad portion 14, with a payload 16 adapted to be received within a payload receiving compartment 18 defined in a front end 20 of the sabot portion 12.

Figure 2:
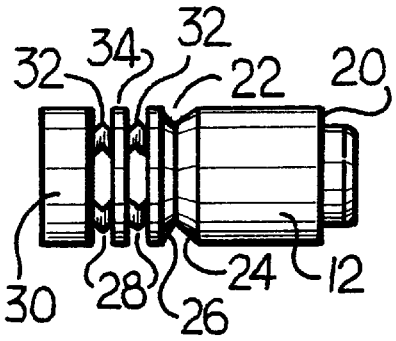
FIG. 2 is an elevational view of the sabot pressure wad in accordance with the present invention.
Figure 3:
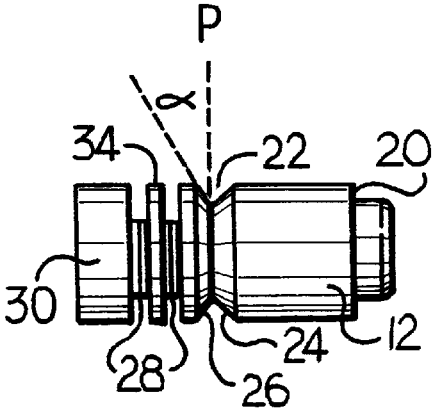
FIG. 3 is a plan view of the sabot pressure wad shown in FIG. 2.
Figure 4:
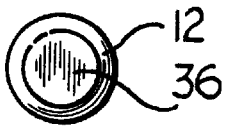
FIG. 4 is a front elevational view of the payload shown in FIG. 1.

Referring to FIGS. 2–4, the sabot portion 12 and the pressure wad portion 14 are shown integrally formed as a unitary piece. The sabot portion 12 has a continuous circumferential wall as illustrated in FIG. 1. The sabot portion 12 includes a V-shaped annular groove or waist 22. The waist 22 includes a first or leading wall 24 and a second or deflecting wall 26. A deflection angle a is defined between the deflecting wall 26 and a plane P bisecting the waist 22 perpendicular to the longitudinal axis of the sabot portion 12.

The pressure wad portion 14 includes a shock absorbing device 28 and a gas seal 30. The shock absorbing device 28 is defined between the sabot portion 12 and the gas seal 30. The shock absorbing device 28 includes a plurality of chevrons 32 integrally formed with and extending between the gas seal 30 and the sabot portion 12. The gas seal 30 and the sabot portion 12 have substantially the same outer diameter.

The pressure wad portion 14 further includes a separating disc 34 located between the gas seal 30 and the sabot portion 12. The separating disc 34 has an outside diameter substantially the same as the outer diameter of the gas seal 30 and the sabot portion 12.

The sabot portion 12 and the pressure wad portion 14 are preferably injection molded as a single unitary piece, thereby forming the sabot pressure wad 10. The sabot pressure wad 10 is preferably made of a suitable polymer and/or copolymer material.

Figure 5:
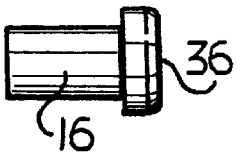
FIG. 5 is a side elevational view of the payload shown in FIG. 4.

FIGS. 4 and 5 show the projectile or payload 16 adapted to be received within the payload receiving compartment 18 in the sabot portion 12. The particular payload shown in FIGS. 4 and 5 is a slug. Alternatively, the payload 16 may be wax, a rubber bullet, a mixture of explosive powder and primer, or a penetrator round. The payload 16 is further adapted for an interference fit within the payload receiving compartment 18. The payload 16 includes a cover 36 configured to cover the opening to the payload receiving compartment 18. The cover 36 is important for aerodynamic stability of the sabot pressure wad 10. In a preferred embodiment, the payload 16 is a cylindrical lead slug with an integrally formed circular cover 36.

Figure 7:
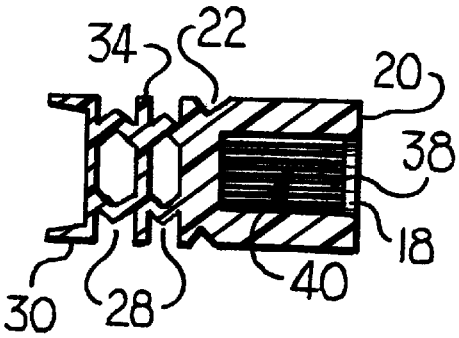
FIG. 7 is a sectional view along section "A—A" of the sabot pressure wad shown in FIG. 6.
Figure 6:
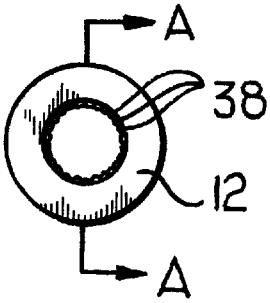
FIG. 6 is a front elevational view of a sabot pressure wad in accordance with the present invention.

FIGS. 6–7 show the payload receiving compartment 18 in accordance with the present invention. The payload receiving compartment 18 includes at least one spline 38 on an interior surface 40 of the payload receiving compartment 18. The splines 38 are oriented substantially parallel to the longitudinal axis of the sabot pressure wad 10. The splines 38 are adapted to create an interference fit between the payload 16 and the payload receiving compartment 18 to secure the payload 16 in place.

Figure 8:
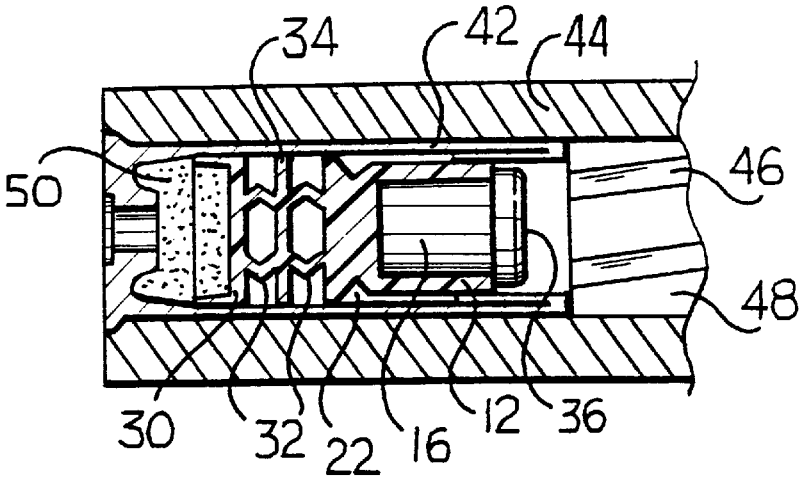
FIG. 8 is an elevational sectional view of a sabot pressure wad in accordance with the present invention loaded in a shotgun shell casing and received within a shotgun barrel.
Figure 9:
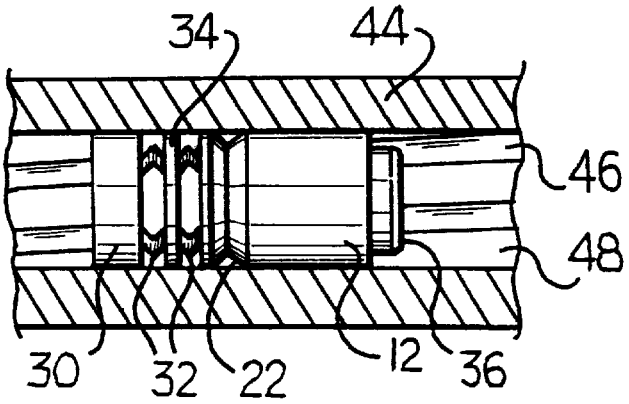
FIG. 9 is an elevational view of the sabot pressure wad in accordance with the present invention immediately after firing with a shotgun barrel in partial sectional elevation.
Figure 10:
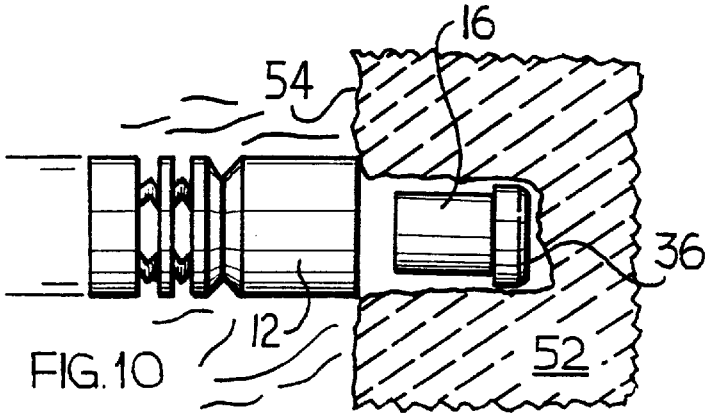
FIG. 10 is an elevational view of the sabot pressure wad in accordance with the present invention shown impacting a target.

Referring to FIGS. 8–10, exemplary operation and use of the sabot pressure wad 10 will be described. FIG. 8 shows the sabot pressure wad 10, preferably incorporating a cylindrical slug as the payload 16, received within a firearm round or shell casing 42, and the shell casing 42 received within a gun barrel 44. The gun barrel 44 may or may not include rifling 46 on an internal surface 48. The sabot pressure wad 10 is positioned within the shell casing 42 so that the gas seal 30 of the pressure wad portion 14 substantially seals off a powder charge 50 of the shell casing 42 from the sabot portion 12.

FIG. 9 shows the sabot pressure wad 10 after firing and traveling in the gun barrel 44. The outer edge of the gas seal 30, the separating disc 34, and the sabot portion 12 are in contact with the internal surface 48 of the gun barrel 44. The rifling 46 on the internal surface 48 of the gun barrel 44 acts upon the outer edge of the gas seal 30, the separating disc 34, and the sabot portion 12 to impart rotation to the sabot pressure wad 10 and the payload 16 received therein. The gas seal 30 traps gas escaping from the compression of the powder charge 50 during firing. The separating disc 34, located between the chevrons 32, traps any escaping gas that the gas seal 30 is not able to contain. The chevrons 32 absorb the shock produced during compression of the powder charge 50 when the shell casing 42 is struck during the firing process. The chevrons 32 compress to absorb the shock of the explosion accompanying the compression of the powder charge 50 during firing. This prevents shock damage to the sabot portion 12 and the payload 16. The chevrons 32 remain axially compressed as a result of the firing process.

FIG. 10 shows the sabot pressure wad 10 after exiting the gun barrel 44 and impacting a target 52. The sabot portion 12 and the payload 16 remain connected after exiting the gun barrel 44 and during the flight to the target 52. During the flight to the target 52, the waist 22 deflects the high velocity air passing over the sabot portion 12 outward and away from the chevrons 32, the separating disc 34, and the gas seal 30 at the chosen deflection angle $\alpha$. The deflection angle $\alpha$ is chosen to reduce the turbulence of the air flow passing over the chevrons 32, the separating disc 34, and the gas seal 30, so that the drag coefficient of the sabot pressure wad 10 is reduced. In the preferred embodiment, the deflection angle $\alpha$ is between about 30° and 60° and is preferably 45°. Upon impacting the target 52, the payload 16 separates from the sabot portion 12 and penetrates the target 52. The sabot portion 12 and the integrally formed pressure wad portion 14 may fall away from a target surface 54 as the payload 16 enters the target 52.

The sabot pressure wad 10 may also be used with black powder rifles. In that case, the shell casing 42 is eliminated and the sabot pressure wad 10 is loaded directly into the black powder rifle barrel adjacent the charge.

The sabot pressure wad 10, in accordance with the present invention, results in numerous advantages over the prior art. First, the sabot pressure wad 10, when moving down range toward a target 52 with a payload 16, has a higher bullet coefficient rating compared to other sabot slugs, foster slugs, and bullets of the same type currently in use in conventional hunting practices, military, and police use. Next, the sabot pressure wad 10 is much cheaper to produce than other sabot slugs, foster slugs, and bullets of the same type because only one mold is necessary to form the sabot pressure wad 10, resulting in reduced production costs. Additionally, the sabot pressure wad 10 eliminates the need for a separately formed pressure wad, further reducing production costs. Further, different payloads 16 can be incorporated into the sabot portion 12 of the sabot pressure wad 10 including but not limited to lead slugs, wax, rubber bullets, explosive powder and primer, and penetrator rounds. Finally, test results show that perfectly round holes are formed in the target 52 by the payload 16 carried by the sabot pressure wad 10 at 30 yards. The invention is believed capable of delivering payloads accurately at distances up to 1,000 yards.

While the preferred embodiment and presently known best mode of the invention has been described above, various modifications and variations of the invention may be made without departing from the spirit and scope of the invention.

I claim:

1. A sabot pressure wad for traveling downrange to a target with a payload, comprising:

a sabot portion having a continuous circumferential wall defining a payload receiving compartment; and a pressure wad portion formed integrally with the sabot portion and including a gas seal and a shock absorber, with the shock absorber formed between the gas seal and the sabot portion, and with the gas seal and the sabot portion having substantially the same outer diameter, wherein the sabot portion further defines an annular V-shaped groove defined in the sabot portion adjacent the pressure wad portion, with the groove defined by two opposing planar walls, and with a leading wall of the two planar walls facing substantially away from a direction of flight for the sabot pressure wad and an air deflecting wall of the two planar walls facing substantially in the direction of flight for the sabot pressure wad, and wherein the air deflecting wall defines a deflection angle with a plane intersecting the groove, for deflecting air flows outward and away from the pressure wad portion when the sabot pressure wad is in flight.

2. The sabot pressure wad of claim 1, wherein the deflection angle is between 30° and 60°.

3. The sabot pressure wad of claim 2, wherein the deflection angle is 45°.

4. The sabot pressure wad of claim 1, further including a separating disc formed integrally with the shock absorber and having substantially the same outer diameter as the gas seal and the sabot portion.

5. The sabot pressure wad of claim 1, wherein the shock absorber is formed as a plurality of chevrons extending between the gas seal and the sabot portion.

6. The sabot pressure wad of claim 1, wherein the sabot pressure wad is injection-molded as a one-piece plastic sabot pressure wad.

7. The sabot pressure wad of claim 1, further including at least one spline formed in an interior of the payload receiving compartment.

8. The sabot pressure wad of claim 1, wherein the sabot portion has a substantiay smooth, cylindrical outer surface.

9. A firearm round, comprising:

a unitary sabot pressure wad further including:

a sabot portion defining a payload receiving compartment, said compartment having a plurality of splines therein so as to receive a payload with an interference fit; and a pressure wad portion formed integrally with the sabot portion and including a gas seal and a shock absorber, with the shock absorber formed between the gas seal and the sabot portion, and with the gas seal and the sabot portion having substantially the same outer diameter, wherein the sabot portion further defines an annular V-shaped groove in an outer surface thereof adjacent the pressure wad portion, defined by two opposing planar walls, with a leading wall of the two planar walls facing substantially away from a direction of flight for the sabot pressure wad and an air deflecting wall of the two planar walls facing substantially in the direction of flight for the sabot pressure wad, and wherein the air deflecting wall defines a chosen deflection angle with a plane intersecting the groove; and a payload positioned in the payload receiving compartment defined by the sabot portion of the sabot pressure wad, wherein the payload remains in contact with the sabot pressure wad after firing at least until impact with a target.

10. The firearm round of claim 9, wherein the payload is a solid mass.

* * * * *

UNITED STATES PATENT AND TRADEMARK OFFICE

CERTIFICATE OF CORRECTION

PATENT NO. : 6,067,909

DATED : May 30, 2000

INVENTOR(S) : Richard G. Knoster, Jr.

It is certified that error appears in the above-identified patent and that said Letters Patent is hereby corrected as shown below:

Column 3 Line 7 "angle a" should read --angle α--.

Claim 8 Column 6 Line 2 "substantiay" should read --substantially--.

Signed and Sealed this

Third Day of April, 2001

*Attest:*

NICHOLAS P. GODICI

*Attesting Officer*

*Acting Director of the United States Patent and Trademark Office*